US009799307B1

(12) United States Patent
Minasi

(10) Patent No.: US 9,799,307 B1
(45) Date of Patent: Oct. 24, 2017

(54) SADDLERAIL BRIDGE

(76) Inventor: Michael Minasi, Bethany, CT (US)

( * ) Notice: Subject to any disclaimer, the term of this patent is extended or adjusted under 35 U.S.C. 154(b) by 639 days.

(21) Appl. No.: 13/368,495

(22) Filed: Feb. 8, 2012

Related U.S. Application Data

(60) Provisional application No. 61/440,888, filed on Feb. 9, 2011.

(51) Int. Cl.
*G10D 3/04* (2006.01)
*G10D 1/08* (2006.01)

(52) U.S. Cl.
CPC ..... *G10D 1/085* (2013.01); *G10D 3/04* (2013.01)

(58) Field of Classification Search
CPC ..... G10D 3/04; G10D 3/12
USPC ..... 84/297 R, 298, 307–310
See application file for complete search history.

(56) References Cited

U.S. PATENT DOCUMENTS 6,706,957 B1 * 3/2004 Merkel ..... G10D 3/12 84/314 N
2010/0236375 A1 * 9/2010 Dunwoodie ..... 84/297 R

* cited by examiner

*Primary Examiner* — Kimberly Lockett
(74) *Attorney, Agent, or Firm* — The Roy Gross Law Firm, LLC; Roy Gross

(57) ABSTRACT

The invention pertains to improvements to stringed instrument bridges that set intonation by adjusting individual string length. Suited for guitars with pole mounts and arch top bridge bases, the invention can be adapted to bass guitars, acoustic flat top guitars and other stringed instruments. The invention uses interchangeable bridge bar and saddlerail components constructed from a variety of materials. These different materials influence tone, sustain, attack, harmonics, and "feel". The ability to quickly interchange each string's saddlerail material independently for its tonal relationship to the bridge bar material enables the user to control the bridge's influence on the instrument's tone and response freely and in numerous ways, thereby designing the bridge to the instrument. The invention's design eliminates bothersome bridge issues including over-engineering, unwanted movement, unwanted vibration, angular string bends, obstructed tailpiece string slope, and outdated, unnecessary features. It optimizes balanced, accurate string vibration transference and increases palm muting comfort.

35 Claims, 5 Drawing Sheets

SADDLERAIL BRIDGE

CROSS-REFERENCES TO RELATED APPLICATIONS

This application claims priority to and benefit of the filing date of U.S. Provisional Application Ser. No. 61/440,888 filed Feb. 9, 2011 which is incorporated herein by reference in its entirety.

STATEMENT REGARDING FEDERALLY SPONSORED RESEARCH OR DEVELOPMENT

"Not Applicable"

FIELD OF THE INVENTION

The invention pertains to a guitar bridge and more particularly a guitar bridge having a bridge bar and a one piece combination rail and string saddle which mount on arch top bridge bases, rigidly mounted or "pole" mounted guitar bridges that become fixedly mounted to the body of the instrument and can be adapted to bass guitars and acoustic flat top guitars.

BACKGROUND OF THE INVENTION

Guitar bridges that are affixed to the body of the guitar and separate elements secured to the body of a guitar are known.

Referring to FIG. 1, a tailpiece 2 is mounted on a body of a guitar and holds the ball end of strings 5. The tailpiece 2 provides the mechanical strength for the tension of the strings against the body of the guitar. The strings 5 then pass over a bridge 3 which is used to set the intonation of the guitar at the bridge so the guitar can be properly tuned. The bridge also supports the strings the proper distance from the fretboard/neck 7. It also has to be strong enough to support the considerable downward string tension often over 200 lbs. In an electric guitar, the strings 5 will also pass over one or more magnetic coils or pickups 10. The pickups 10 are used to convert string vibration into electrical energy that is sent to an amplifier (not shown). The strings then extend over the neck 7 and frets 12 and pass over a nut 6 to tuning pegs 8 in the headstock 9. The tuning pegs 8 are adjustable to increase or decrease the tension of the strings 5 to effectively tune the guitar to a variety of guitar tunings. Between the nut 6 and the bridge 3 are the frets 12 between which the strings 5 are depressed to affect string 5 length to thereby change the frequency at which that particular string vibrates producing pitch.

The material of the body 1, neck and fret board 7 material, size and design of the head stock 9, tuning pegs 8 mass, the quality of the pickups 10, the type and adjustment of the tailpiece 2, the accuracy of the placement of the strings 5 above the fretboard 7, the placement of the frets 12, and the quality, materials, design, and adjustment of the bridge 3 are all important to the overall sound of the guitar.

It is established (old) to provide bridges with longitudinally adjustable saddles to adjust string nodal points as for example U.S. Pat. No. 9,346,78 issued in 1909 and U.S. Pat. No. 2,740,313 issued in 1956.

What is needed is a bridge design that allows its components material composition to be that of less rigid materials such as wood, bone, or manmade materials in addition to metals for their influence on tone and feel while still maintaining longitudinally adjustable saddles for string nodal point adjustment.

What is needed is a bridge whose saddles and bridge bar are of sufficient mass to withstand string tension when constructed in less rigid materials such as wood, bone, and man-made materials.

What is needed is a bridge that enables the user control over the influence of its separate components for their combined influence on tone and feel for each individual string.

What is needed is a bridge that enables the user to interchange its separate components for their combined influence on tone and feel quickly and easily making it practical to do at recording sessions, in-between performance sets, and instances where time is a concern.

What is needed is a curved bridge bar that preferably follows the curvature of the neck without unnecessary engineering and manufacturing costs.

What is needed is a bridge whose bridge bar has enough balanced mass from string to string to allow equal influence from its string saddle components.

What is needed is a bridge whose saddle mass to bridge bar mass ratio is calculated to allow its material composition to influence tone and feel relative to material composition of its separate components.

What is needed is a bridge that contains as few parts and contact points as is possible to eliminate noise and unwanted vibration that can also alter intonation settings.

What is needed is a bridge that allows the user to adjust string spacing without the negative impact lateral tension exerted on the saddle by the strings' descent to the tailpiece imposes on the transmission of vibration to the instrument.

What is needed is a bridge whose saddles eliminate angular and compound angular string bends.

What is needed is a bridge that assures maximum string vibration transfer at the saddle while optimizing the influence each individual saddle material provides to tone and feel.

What is needed is a bridge whose bridge bar allows the chosen saddle material to influence each string it supports with less influence from its neighboring saddle material.

What is needed is a bridge that allows for the string's unobstructed descent to the tailpiece.

What is needed is a bridge that incorporates elements that provide comfort during hand to bridge contact and while palm muting.

What is needed is a bridge that eliminates out-dated, unnecessary, and complicated engineering.

What is needed is a bridge that eliminates unwanted vibration and maintains close tolerances in the $100^{ths}$ or $1000^{ths}$ of an inch without prohibitive manufacturing costs.

The SaddleRail Bridge disclosed herein fulfills these needs.

BRIEF SUMMARY OF THE INVENTION

To preface the invention's significant improvement over the prior art, it is pertinent to state that the Tune-o-Matic™ bridge U.S. Pat. No. 2,740,313 (year 1956) closely represents a baseline in which to illustrate the significant prior art improvement of the SaddleRail Bridge.

The present invention is a significant improvement of the prior art in that its design enables its manufacture in a combination of less rigid materials such as wood, bone, and man-made materials, e.g., various plastics or composites, in addition to metals while maintaining string nodal point intonation adjustment capabilities. The design and mass of its saddlerail and bridge bar enable the user the option to interchange this variety of materials for their impact on the tone and feel of the instrument for each string individually.

The invention's curved bridge bar design preferably follows the instrument's neck radius, thereby eliminating the need for such things as mechanical string height adjustment devices, adjustment screws, cam designs, etc. or the Tune-o-Matic's system of interior recesses and stepped ways for examples.

The design of the invention uses string tension to compress the saddlerails in the bridge bar and a setscrew to lock each saddlerail in its dovetail slot upon intonation. Its design eliminates unnecessary component parts, as much as 75% of the component contact points, and the unnecessary, outdated intonation adjustment screws found in a typical Tune-o-Matic™ style bridge for example, while allowing for easy intonation adjustment. Its design logic simplifies complicated mechanical mechanisms engineered to adjust intonation.

The Tune-o-Matic™ style saddle and similar saddles are angular as they descend to the tailpiece thereby creating angular bends at the saddle/string contact point. This angular string bend has to be corrected each time the string is pulled closer to the instrument's nut through tuning and can cause intonation problems during performance. The SaddleRail Bridge's curved saddles eliminate angular string bends while providing considerable string contact with the saddle.

The SaddleRail bridge dovetail slots allow space for a string to descend to the tailpiece from its saddles. This eliminates string contact with the rear bridge bar wall of a typical Tune-o-Matic™ style bridge for example. This contact, that occurs in the Tune-o-Matic™ style bridge, relative to neck pitch and stop tailpiece adjustment heights, creates additional contact points, compound angular string bends, and has an influence on harmonics, fundamental strength, string tension, and sustain.

Saddle replacement procedure on a SaddleRail Bridge is fast and simple and requires no real tool related skill set.

The invention's tolerance specifications are preferably in the $100^{ths}$ or $1000^{ths}$ of an inch to assure the absence of noise and unwanted vibration associated with loosely fitting parts, thereby eliminating negative impact on string vibration transmission and intonation without expensive manufacturing costs due to simple design.

The bridge bar and saddlerails can be comprised of wood, metal, or manmade materials wherein, for example, two or more saddlerails installed in a chosen bridge bar material are comprised of the same material or wherein bridge bar and saddlerail materials can be arranged in any combination of said materials.

In one embodiment, the SaddleRail Bridge for a stringed instrument comprises saddlerails with each rail member preferably having a vertical threaded insert when the saddlerail is made of materials such as wood, requiring a more durable threaded hole. The insert is placed into a vertical hole formed from the top surface through the bottom surface of rail. A setscrew, preferably a metal setscrew, configured for insertion into an insert, is inserted into the insert wherein the setscrews upon rotation thereof into the rail make contact with the bridge bar to fixedly lock the saddlerail to the bridge bar. Reversing the rotation of the setscrew allows for having a removable and replaceable association of the saddlerail with the bridge bar as assembled units.

In a different embodiment, the rail of each saddlerail has a tapped threaded hole for each rail when comprised of materials such as metal wherein a vertical hole is formed from the top surface through the bottom surface of a rail and a setscrew, preferably metal, is configured for insertion into each of the setscrew threaded holes. The setscrews upon rotation move into the rail and contact the bridge bar to fixedly lock the saddlerail to the bridge bar. Reversing the rotation of the setscrew allows for having a removable and replaceable association of the saddlerail with the bridge bar as assembled units.

The SaddleRail Bridge is comprised of any combination of materials such as wood, metal, or manmade materials set transversely to the strings and can be adapted to fit into an acoustic flat top guitar's bridge plate modified for its use (or by replacing the bridge plate of an acoustic guitar with an adapted floating bridge base and added tail piece string anchoring system design) thereby effectively retrofitting the instrument and other stringed instruments in like manner with a SaddleRail Bridge.

The saddle of the saddlerail comprises a nodal point edge transverse to the strings with the width of the saddle comprising a front saddle surface between the saddle and the instrument nut and below said nodal point edge to the top adjoining surface of the rail forming a preferably right angle and further providing enough distance between the nodal point and the rail to thereby allow unobstructed string waver between the nodal point and nut while providing a curved top saddle surface, e.g., in the form of a radial arc, from the nodal point to the saddle's rear termination.

The bridge bar comprises a plurality of saddlerails designed to be moved with respect to a plurality of dovetail slots in a direction parallel to the strings thereby establishing a string nodal point at a saddle with that of the nodal point at the nut thereby yielding adjustable intonation.

The plurality of saddlerails are designed to be moved with respect to the plurality of dovetail slots in a direction parallel to strings wherein saddlerails are free to cantilever the bridge bar to adjust individual string nodal points.

The saddles wherein the saddle shoulder surfaces are transverse to the bridge bar are ergonomically curved or radius (i.e., in the shape of a radial arc).

The outside top edges of the bridge bar may be ergonomically curved or radius and the underside of the radius bridge bar may be chamfered between flanking mounting holes.

The invention's bridge bar is set transversely to the strings and is fit with vertical alignment mounting holes at each end of the radius bridge bar at standard distances which accept existing thumb wheel posts sized for existing arch top bridge bases and rigidly mounted or "pole" mounted guitar bridges that become fixedly mounted to the body of the instrument.

The bridge bar has a plurality of upwardly facing, dovetail slots (mortises) open at the top, front, and rear of said bridge bar therein at transversely longitudinal spaced points along said bridge bar wherein the bridge bar can optionally be flat wherein its top edges can be curved and wherein the bottom edges can be chamfered.

DETAILED DESCRIPTION OF THE INVENTION

Figure 1:
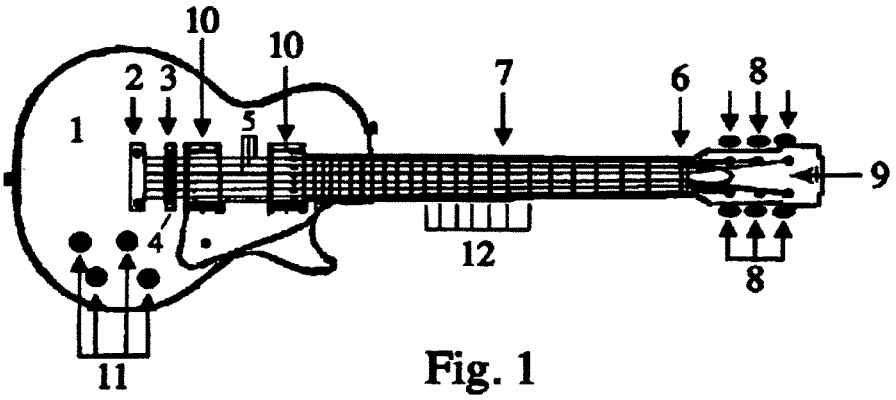
FIG. 1 is a drawing of a six string guitar with the inventive SaddleRail Bridge and a typical stop tailpiece.
Figure 3:
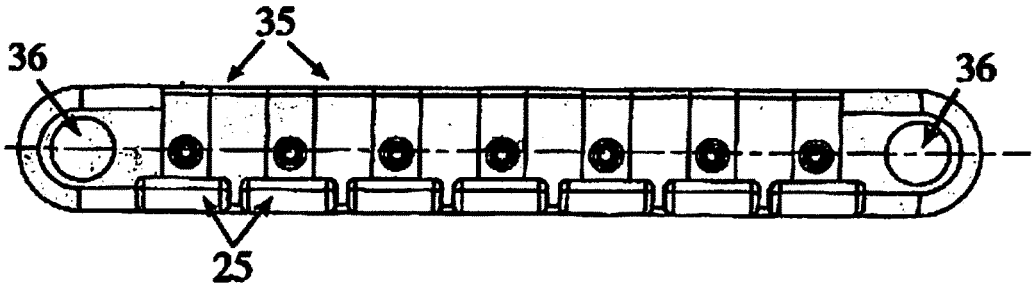
FIG. 3 is a top view of a seven string SaddleRail Bridge.
Figure 4:
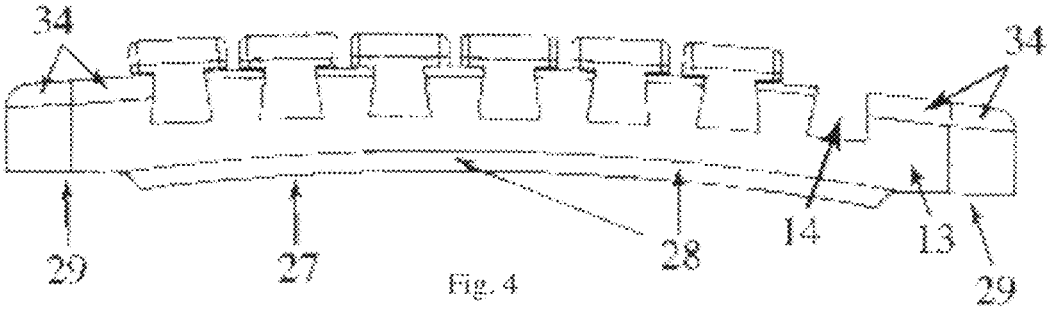
FIG. 4 is a rear view of the seven string SaddleRail Bridge omitting one saddlerail.
Figure 5A:
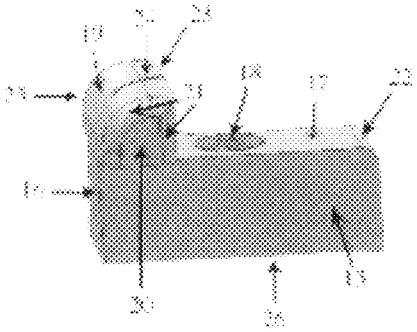
FIG. 5A is a three dimensional shaded perspective side view of a saddlerail.
Figure 5B:
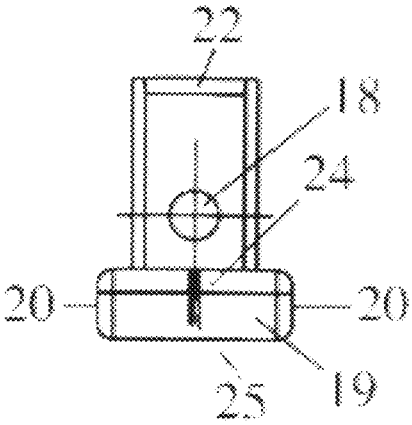
FIG. 5B is a top view of a saddlerail.
Figure 5C:
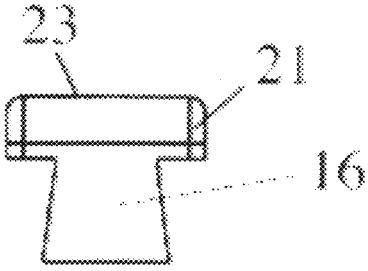
FIG. 5C is a rear view of a saddlerail.
Figure 5D:
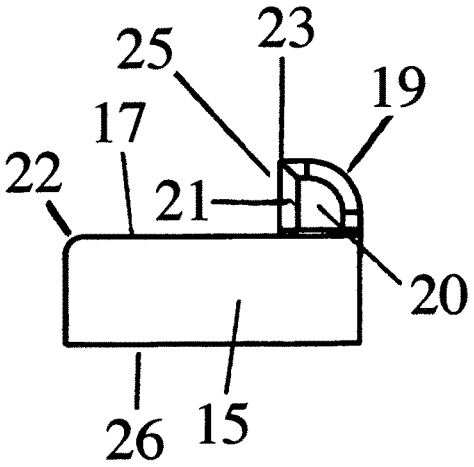
FIG. 5D is a side view of a saddlerail.
Figure 6:
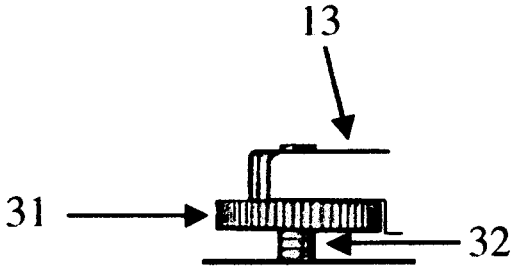
FIG. 6 is a view of a typical thumb wheel apparatus.

FIG. 1 shows a guitar having a bridge 3 that rests on standard thumbwheels 31 (as shown in FIG. 6) screwed onto posts 32 (see FIG. 6) inserted into holes 36 (FIG. 3) in the bridge bar 13 (FIG. 4). The tailpiece 2 (FIG. 1) secures each of the six strings 5 at the string ball end. The strings 5 extend over the bridge 3 and rest in grooves 24 (FIG. 5B) cut into the saddles 25 (FIG. 5A) upon installation and create a nodal point. They then extend over the neck 7 (FIG. 1) and rest in slots at the nut 6 creating the second nodal point. From this point the strings extend and attach to peg tuners 8 in the headstock 9. This particular guitar in FIG. 1 provides for electric amplification by magnetic coils known as pick-ups 10 and tone and volume controls 11. The bridge of the invention may, however, be used with other stringed instruments.

Figure 11:
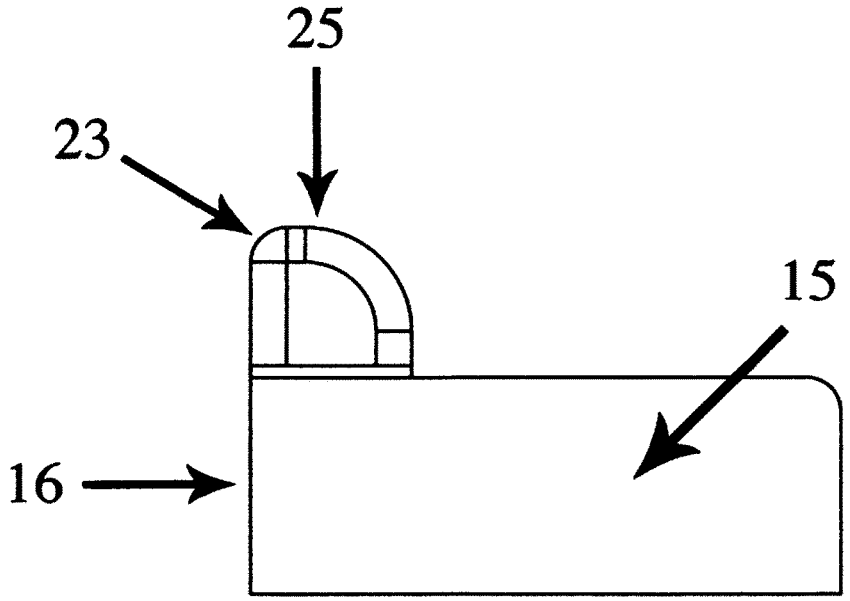
FIG. 11 is a side view of a reversed saddle saddlerail.
Figure 9:
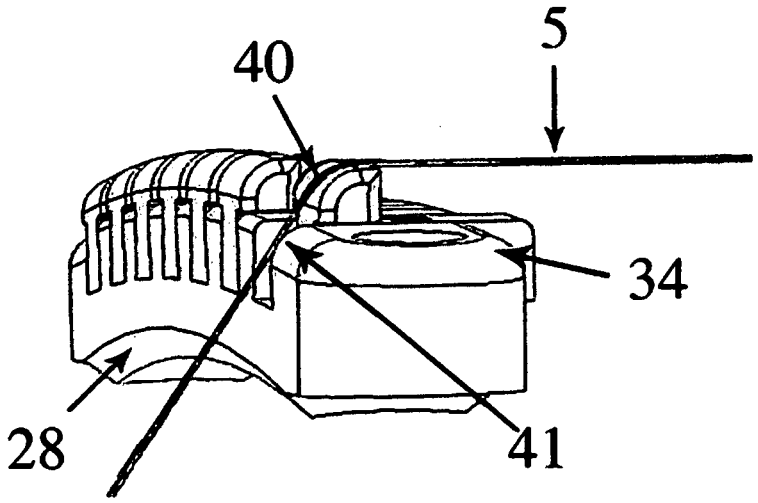
FIG. 9 is a view of a string's unobstructed descent through a dovetail slot from its saddle.

The instrument bridge bar 13 (FIG. 4) includes for each individual string 5, profiled slots (mortises) such as dovetails 14 (FIG. 4) that are preferably equally spaced in the bridge bar 13 (FIG. 4) and accept the sliding counterpart profiled one piece rails (tenons) 15 (FIG. 5A) with saddles 25, referred to as saddlerails, to support each string 5, and are freely moveable manually to adjust accurate string length intonation. Saddles have a curvature 19 (FIG. 5A) to the top of the rear wall 16 of the rail 15. The edges 21 of the flanking lateral shoulders 20 of each saddle 25 are preferably curved. The front edge 22 of the rail 15 is preferably curved. The saddle 25 provides a nodal edge 23. A groove 24 for the string 5 to rest in must be made (e.g., filed) into the saddle 25 from its location in the nodal edge 23 and extend to the curvature 19 for the string 5 to descend to the tailpiece 2 (FIG. 1). A setscrew 18 (FIG. 2) is located in the rail 15 (FIG. 5A) and extends from the top surface 17 (FIG. 5A) of the rail 15 to the bottom surface 26 of the rail 15 to lock the saddlerail (FIG. 5A) in the bridge bar 13 (FIG. 4). The bottom surface 27 (FIG. 4) of the bridge bar 13 is curved laterally and its bottom outside edges are preferably chamfered 28 (FIG. 9). In a second embodiment the saddlerail's saddle 25 (FIG. 5A) is reversed (FIG. 11) wherein the nodal point edge 23 resides on the same plane as the rear wall 16 of the rail 15 allowing the saddlerail to be reversed in the dovetail slot 14 (FIG. 4) to extend the saddlerail's nodal point adjustment range. The saddle can be positioned either: a) at or near the rear of the rail with the hole for the setscrew between the face of the saddle and the nut (first embodiment) or b) at or near the front of the rail such that the saddle is positioned between the hole for the setscrew and the nut (second embodiment), in both cases with the face 44 (FIG. 5E) of the saddle facing toward the nut and the curved rear portion of the saddle facing toward the tailpiece. In use, it is preferable that the saddle and rail are positioned such that the string will not contact the bridge bar as it extends to the tailpiece. The area of the bridge bar 13 (FIG. 4) bottom surface 27 that rests on a standard thumbwheel 31 (FIG. 6) is countersunk 29 (FIG. 4) the width and depth of a thumbwheel 31 (FIG. 6). The outside edges 34 (FIG. 4) of the bridge bar 13 (FIG. 4) are preferably curved. The outside edges 35 (FIG. 3) between the rails 15 (FIG. 5) are preferably curved. Whenever something is referred to as being curved, the curve may be, e.g., a radial arc, e.g., an arc that would form a part of a circle.

Strength

A Tune-o-Matic™ style and similar bridge bars contain a plurality of open cavities called recesses for the saddles to travel in to either shorten or lengthen the string for intonation adjustment by its adjustment screw. Because of this design, the Tune-o-Matic™ and similar bridge bars lack the strength to withstand the 200+lbs of string tension a six string guitar could impose if the bridge bar were constructed of less rigid materials such as wood, bone or many other manufactured materials. The Tune-o-Matic™ saddle with its "downwardly facing tongues or stems" does not possess the mass or strength needed for it to be constructed of these materials as well. This restricts its capacity to utilize the tonal properties the aforementioned materials impart on tone, etc. and limits its material composition to higher strength materials such as metal. Engineered mechanical style bridges designed to adjust string heights and intonation are all limited to materials such as metal with relevant impedance.

The SaddleRail Bridge is designed to withstand string tension allowing its material composition in wood, bone and many manufactured materials, in addition to metal. It uses string tension to compress its saddlerails within the bridge bar dovetail slots thereby locking the saddlerail in the bridge bar and maintaining ample continuous mass the length of the bridge bar much the same way joist, rafters and girders are used in the construction of buildings to carry load. The strength of the SaddleRail Bridge allows the user to exploit the influence various, less rigid materials such as wood have on sustain, string attack, harmonics, tone and human physical response to string vibration known as "feel". Both the bridge and saddlerails can be freely interchanged for their material's tonal character enabling the user to optionally select a saddlerail for each individual string for its tonal relationship to the characteristics of the selected bridge bar material enabling the user to design the bridge to each instrument it is mounted on.

Balanced Mass

The bridge bar (or bridge member) on a typical Tune-o-Matic™ style bridge's top surface is flat. The bridge bar saddle supports referred to as "shoulder like ways" (see U.S. Pat. No. 2,740,313) are raised or lowered within a plurality of upwardly opening longitudinally spaced recesses supporting the saddles by their shoulders in the bridge bar to match neck curvature of the instrument so that string height above the frets on a curved neck are equal for all the strings. Neck curvature, or "radius", can range from 7.25" to 20". Because of the additional material needed to increase heights of the "shoulder like ways" the greatest mass is under the middle strings at the curvature apex and this material decreases laterally to the $1^{st}$ and $6^{th}$ strings as the "shoulder like ways" are lowered inside the recesses of the bridge bar to follow the neck curvature of a six string guitar.

The Tune-o-Matic™ style bridge's saddle shoulders rest on ways in each string cavity and, as U.S. Pat. No. 2,740,313 states, are the transmitters of string vibration to the bridge bar. The bottom surface of the saddle base referred to as "tongues or stems" do not contact the bridge bar recess floor for support or to transmit vibration thereby deferring to the saddle shoulders. This equates to a small surface area for vibration transference.

The adjustment screws, screw holes and possible retaining clips of a Tune-o-Matic™ style bridge and similar bridges follow the neck curvature on the bridge bar wall as well and therefore are in different locations and not consistent for each string on the bridge bar. The varying heights/mass of the ways, the adjustment screws and screw holes all contribute to an unequal influence in the transmission of vibration for each string.

The SaddleRail bridge bar is curved to correspond to the neck curvature (e.g., a radial arc). This allows the equal-sized saddlerails to follow neck curvature without the need for engineering elements such as the "shoulder like ways" in a Tune-o-Matic™ style bridge.

The bridge bar provides an equal mass under each saddle rail assuring a balanced, equal influence in the transmission of string vibration allowing for the incremental string gauge increases in string sets to be realized more accurately and the interchange of Saddlerail materials for their influence on tone and feel to be realized accurately and equally from string to string.

There are no adjustment screws, adjustment screw holes, adjustment screw contact points, or screw retaining clips producing unwanted noise or affecting or interfering with the transmittance of vibration.

String Spacing

String spacing on the Tune-o-Matic™ style bridge's saddles and their correlation to string spacing in the tailpiece can be a factor in the transmission of string vibration and compound angular string bends. String spacing is one of the major elements in "setting up" or adjusting a guitar for the person using it. The musician's hand size, technique, and string gauge are major factors in determining string spacing adapted to the player for the best possible comfort and technique. String spacing refers to the lateral position of the strings on the bridge.

The strings sit in these grooves in the saddles and are thus are held in position. The grooves should be cut a depth appropriate to string gauge and located within the saddles relative to the equal distance between the strings' outside surfaces and not the strings' centers. Evenly spaced string centers will not feel evenly spaced to the musician as the heavier gauge bass strings decrease the distance between the strings and the strings feel crowded together. This crowded feel increases as string gauge diameters increase and the distances between the strings continue to decrease. The outside string hole spacing in a standard stop tailpiece is 2" and corresponds to the outside string spacing in the evenly spaced prenotched saddles found in Tune-o-Matic™ bridges at 1 15/16" to 2 1/16". This equates to a 1/8" variable difference. (Tune-o-Matic™ style bridges can be obtained without pre-cut notches as well.) Generally the industry has a disregard for proper string spacing as is evidenced by so many evenly spaced precut saddles being sold. Proper string spacing requires the string centers to be unevenly spaced. This is in conflict with the evenly spaced holes of a tailpiece with a 2" outside string spacing. The 1/8" variation in string spacing of the bridge and tailpiece in the Tune-o-Matic™ technically creates this conflict before proper spacing but proper string spacing dramatically increases the discrepancy.

The string's misalignment of the bridge saddles and the tailpiece is relevant and can have an influence on the even transmission of vibration relative to its angle of descent to the tailpiece's evenly spaced holes. A straight run from the saddle to a perfectly aligned lowered stop tailpiece string hole would impose one angle to the string as the string descends to the tailpiece and technically allow the saddle to center. A compound angle is created when the bridge and tailpiece are misaligned imposing an additional lateral angular bend to the string's descent to the tailpiece. In a Tune-o-Matic™ bridge for example, this lateral string angle will exert force on the saddle, and thereby its saddle tongues, in the lateral direction of the string angle, thereby influencing the tongue's contact with the walls of the shoulder like ways. This force, or tension, is increased as the stop tailpiece is adjusted closer to the body of the instrument and as string gauge increases.

String location within the tailpiece hole can also be contingent upon the ball and winding of the string inserted into the tailpiece and whether this ball and winding allows the string to freely suspend in the tailpiece hole or misalign in the hole created by the aforementioned variable degree of lateral force.

Many factors such as these lead to random string alignment influence. This, compounded by the fact that string spacing should be variable within the various neck widths for each player's hand size requirements, technique preferences, and chosen string gauge, makes it essential that the bridge's saddles not be vulnerable to the influence string projection to the tailpiece can have on the transference of string vibration.

Angular String Bends

Figure 7:
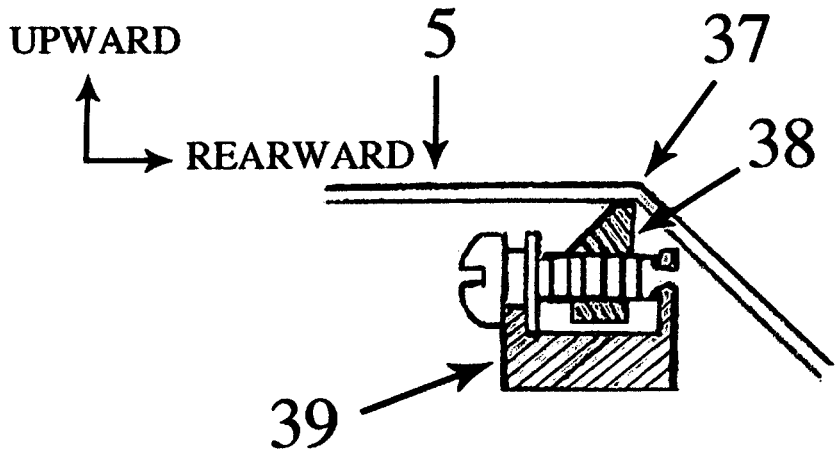
FIG. 7 is a view of an angular string bend on a cross section of a typical Tune-o-Matic™ style bridge saddle in its bridge bar.

In addition to the vibration transmission issues, an angular string bend 37 (FIG. 7) in a Tune-o-Matic™ style Bridge 39 saddle 38 can compromise the integrity of the string 5 and interfere with intonation. This occurs with the saddle angle facing either the tailpiece or the nut (when reversed), as string tension is concentrated at the bridge's saddle. Angular string bends at the bridge's saddles have to be corrected each time the string is stretched and the bend is pulled closer to the instrument's nut through tuning. This is especially true with stop tailpieces adjusted closer to the instrument's body producing sharper string angles. As the string is tightened and pulled past the saddle, angular bends are corrected or straightened thereby stressing the string in varying degrees and shortening string life. In addition, it often takes time for string tension to fully take the angular bends out of heavier gauge bass strings compromising intonation requiring additional time and annoying tuning procedure during a performance. It can require manually pushing the string down with your thumb directly in front of the saddle to straighten the string. This problem is increased when using new strings, utilizing alternate tunings requiring greater leaps in intervals that impose varying degrees of tension on the strings, and frequent tuning changes during performance.

The saddle of a SaddleRail Bridge is curved from the saddle's string contact nodal point to the point of string departure 40 (FIG. 9) to the tailpiece eliminating the angular bends that shorten string life and interfere with intonation. This design allows the string to continuously contact the saddle surface area relative to its angle of descent to the tailpiece enabling the string to fully transmit vibration through the saddlerail. The rail is tightly compressed in the bridge bar by string tension eliminating the aforementioned random tonal influence imposed by the string's lateral location in the tailpiece.

The SaddleRail Bridge's saddle shoulders do not make contact with the bridge bar and are not vulnerable to breakage as string placement and string tension is situated over the weight-bearing portion of the saddle in line with the rail. Its saddle shoulders are designed to provide a more continuous longitudinal surface for hand contact comfort during palm muting.

Vibration and Contact Points

The following is an example of the problems that exist to varying degrees with existing adjustable intonation bridges relative to vibration and contact points. Once again the Tune-o-Matic™ style bridge most closely illustrates this.

Tune-o-Matic™ style saddles have to be held by the adjustment screw in order to remain in position in the bridge bar. The slot-head stationary adjustment screw is threaded into a threaded hole in the saddle tongue. It is rotated clockwise and counterclockwise to move the saddle forward and backward parallel to the strings within the bridge bar recesses thereby adjusting string length. Other types of bridges have saddle adjustment systems that work in the same way.

The original Tune-o-Matic™ design U.S. Pat. No. 2,740,313 is clear. Column 2, states at lines 21-30: "The screws have annular grooves 25 at the head ends thereof which receive the edges 26 of the U-shaped recesses in the front walls of the recesses 15 and 16 as is clearly shown in the drawing. This provides an effective support for the screws while permitting the easy removal thereof and the saddle engaged thereby. The thrust load of the strings on the saddles is carried by the ways so that the screws rotate freely, and effective support is provided for the saddle."

This basically means that the screw rests in the U-shaped opening and is secured in place by string tension. This could prove to be a disaster in a live performance as the screw and saddle could easily fall out of its recess upon string breakage requiring its physical location, reinstallation and readjustment of nodal point intonation and string intonation. In addition, the adjustment screws are vulnerable to vibration and movement which translates to noise and unwanted changes to nodal point intonation through normal use. A retaining wire was designed to exert tension on the screw heads in an attempt to prevent them from vibrating, moving, and falling out in the absence of string contact tension as often happens when a string is broken during a live performance. The wire is inserted into a hole below the first string's adjustment screw and extends over the adjustment screw head where it is reinserted into a hole below the sixth string screw head on a six string guitar. The retaining wire is problematic in that the wire itself can lead to unwanted vibration, create noise and can be difficult to disassemble and reassemble without altering its capacity to apply even tension on the screw heads.

The adjustment screw of this Tune-o-Matic™ style bridge and similar bridges enters the front wall of the bridge, threads through the center of the saddle and enters and rests in a hole in the outside rear wall of the bridge bar to keep it in place. In the improved version of the Tune-o-Matic™ bridge the screw is then held in place by an individual screw-retaining clip to keep it stationary during and after its rotation. This totals six contact points per string or thirty-six per six string bridge: 1) the screw head, 2) the screw shaft at its hole in the front wall of the bridge bar, 3) the retaining clip, 4) the screw to saddle contact point, 5) the screw to rear retaining hole, and 6) the saddle to bridge bar contact points. There are actually four possible contact points for each saddle on the bridge bar but as described in the previous section it is unknown when and if they occur in use and that their position can change in the recesses. For this discussion it is assumed there are two contact points, one for each saddle shoulder. These contact points are vulnerable to movement and vibration. As previously stated, the adjustment screws are vulnerable to movement as the strings vibrate and are stretched through use. The retaining wire requires two contact point holes to retain the wire and six additional contact points at each screw head of a six string guitar totaling eight contact points. This wire is problematic in that it vibrates as well. Its effectiveness in locking the intonation has to be in question if it vibrates to the point of being audible. Solutions for retaining wires' problems have been ongoing. There are fifty contact points all vulnerable to vibration with the retaining wire.

An aftermarket improvement to this design replaces the U-shaped recesses in the front walls with a screw hole and retaining clip for the adjustment screw eliminating the need for a retaining wire. Another well known company uses a screw retaining clip referred to as a saddle clip while maintaining the open recesses and also includes the retaining wire and the user has the option of including a plastic washer between the screw head and the screw body in an attempt to tighten and dampen unwanted movement and vibration.

Vibration and Contact Points of a Saddlerail Bridge

Assigning one contact point to the saddlerail in its dovetail slot and two contact points for the set screw, the SaddleRail Bridge has three physical contact points per string totaling eighteen for a six-string guitar, none of which are vulnerable to unwanted movement and vibration. The Tune-o-Matic™ bridge (U.S. Pat. No. 2,740,313) has forty-two to fifty contact points all vulnerable to unwanted vibration and noise for a six-string guitar.

Tone, Interchangeability and the Nodal Point Edge

The following is an example of the problems that exist to varying degrees with existing adjustable intonation bridges relative to tone, interchangeability and nodal point edges. Once again the Tune-o-Matic™ style bridge most closely illustrates this.

Figure 2:
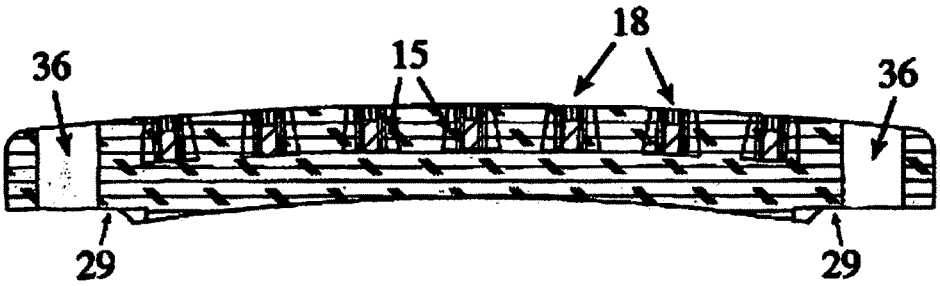
FIG. 2 is a cross section view of the inventive seven string SaddleRail bridge bar with its saddle rails.

The Tune-o-Matic™ style saddle nodal edge string contact point is referred to in U.S. Pat. No. 2,740,313 at column 2, lines 30-34 as follows: "The string rests 28 of the saddles are at one edge thereof, so that although the saddles are of substantial width to provide strength and stability, they may be reversed as indicated in FIG. 2 to substantially doubling the scope of adjustment."

Its stated "substantial width to provide strength and stability" is still too small to allow for its construction in materials such as wood, bone, and many manmade materials within its restrictive metal bridgebar. The low mass of the saddle/tongue design limits the tonal impact of its feasible materials as well. The term "one edge" equates to a minimal string to saddle contact surface area for the transmission of vibration before the saddle makes an angular descent. Some contact area can be filed into the saddle but its angle is restrictive. Its reversibility allows for an approximately 25% increase in its scope of adjustment. When reversed, the saddle has a 90-degree drop and provides zero support and vibration contact surface to the string in its descent to the tailpiece.

Figure 5E:
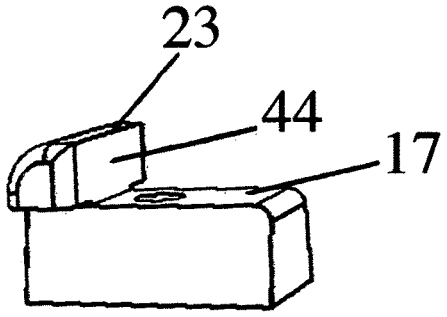
FIG. 5E is a three dimensional perspective side view of a saddlerail.

The SaddleRail Bridge's saddle possesses far greater mass and surface contact area to receive and transmit string vibration to its bridge bar than that of a Tune-o-Matic™ style saddle and similar saddles while also maintaining a distinct nodal point edge. The saddle's front surface 44 (FIG. 5E) between the saddle and the nut 6 (FIG. 1) comprise a right angle with the top surface of the rail 17 (FIG. 5A). For example, a distance between the saddle nodal point edge 23 and the rail's top surface 17 of ⅛ inch provides space for uninterrupted string waver between the saddle nodal point edge 23 and the instrument nut 6 (FIG. 1) nodal point while providing a curved top saddle surface from the saddle's nodal point to the saddle's rear termination. A cam type design, for example would not provide a right angle distinct nodal point edge as the radius of the cam would descend below the string between the nodal point and the nut.

The string's actual contact to saddle surface area is relative to the angle of descent to the tail piece which favorably results in greater contact than its, e.g., 0.14 inch saddle depth and still maintains a distinct nodal point edge. The rail contact surface area inside the dovetail mortises is far greater than any Tune-o-Matic™ style saddle tongue can achieve.

This is significant in that the SaddleRail Bridge's saddle mass is sufficient to allow its material composition to substantially influence tone and accompanying properties enabling it to be interchanged within the interchangeable bridge bar for its tonal character and accompanying properties relative to material choice. This interchange of component materials between the saddlerail and bridge bar allows the user to design the bridge to the instrument.

Balanced Mass

Balanced mass and close tolerances of the saddlerail and bridge bar, as well as the rail's compression within the bridge bar, assure efficient transmission of string vibration. Due to its curved design, the invention's bridge bar allows for a balanced mass of bridge bar material between its saddlerails. This allows the chosen saddlerail material to influence each string it supports as independently as is possible within the bridge bar with as little influence from its neighboring saddlerail material as is possible. This is relevant when interchanging saddlerail and bridge bar materials for their influence on tone and feel for each string individually.

For example, the user might choose an ebony bridge bar with ebony saddlerails. The influence on tone would be consistent with that of ebony. The user could then substitute stainless steel saddlerails in place of the ebony saddlerails to impose the influence stainless steel would bring to an ebony bridge bar. Substituting an aluminum bridge bar for the ebony bar would provide yet another alternative influence to that of ebony. In addition, each individual string can have any saddlerail material assigned to it. For example, if the first string E on a guitar using an ebony bridge bar and stainless steel saddlerail combination were too bright, the user might substitute a rosewood saddlerail to introduce the warmth that rosewood would provide to that string. If the G-string lacked resonance the user might substitute an aluminum or titanium saddlerail, increasing string harmonics. This methodology can be used on each string independently using a variety of materials to obtain the desired tone result for the bass, middle, and treble strings or any combination thereof. The possible combinations are numerous.

The Tune-o-Matic™ style bridge and similar bridges do not allow for this degree of aforementioned interchangeability. Its saddle mass and design is not rigid enough to be constructed in wood, bone, and many man-made materials to carry string load tension and also limits the tonal impact of the feasible higher strength materials as well.

Because of the approximately 200 lbs of combined string tension, the Tune-o-Matic's bridge bar's feasible material composition is limited to high strength materials such as metal to carry string load.

Stop Tailpieces String Contact

Definition: A tailpiece is designed to hold the strings in place at the ball end of the string. A stop tailpiece can be adjusted towards or away from the guitar body to affect harmonics, fundamental strength, string tension, and sustain.

The saddles of a Tune-o-Matic™ style bridge rest on and follow the shoulder like ways to adjust string height to follow neck curvature. As they descend from the highest point of the middle strings to the lowest points at the first and sixth string, the string's distance above the rear bridge wall decreases. Depending on the neck to body pitch, this rear wall can obstruct the string's path to the tailpiece as the string makes contact with the bridge bar rear wall to continue its descent to the tailpiece. This risk is increased as the height distance between the bridge bar and tailpiece is increased. This contact influences the string's transmission of vibration from the saddle to the bridge bar, creates an additional angular string bend, influences the string's transmission of vibration from the saddle to the bridge bar, influences harmonics, fundamental strength, string tension, and sustain.

The SaddleRail bridge bar's dovetail slots allow the strings to pass through the slots (mortises) 41 (FIG. 9) unobstructed to a trapeze tailpiece or stop tailpiece regardless of neck to body pitch. This results in balanced, unhindered control from string to string when adjusting stop tailpiece height and trapeze tailpiece height and afterlength for their influence on harmonics, fundamental strength, string tension, and sustain. It assures maximum vibration transfer at the saddle optimizing the influence each individual saddlerail material provides in designing the bridge to the instrument. It also eliminates additional contact points, eliminates the negative effects angular string bends have on intonation and string life, and the dovetail slot's width allows for significant lateral string spacing adjustment capabilities.

Apagados or "Palm Muting"

Figure 8:
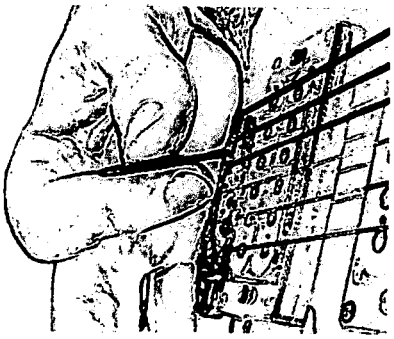
FIG. 8 is a drawing of a palm mute.

Palm muting (FIG. 8) is a common technique used to control the level of string vibration and harmonics. The palm of the bridge hand is placed on the bridge area, typically at the saddles, where varying degrees of pressure on the strings dampen them to create effects that range from a more pronounced sound to a staccato, percussive sound.

Figure 10:
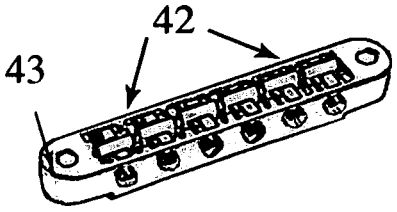
FIG. 10 is a drawing of a typical Tune-o-Matic™ bridge.

A typical Tune-o-Matic™ style bridge bar top surface is flat 42 (FIG. 10) and not curved to the outside edges of the postholes 43. This interrupts the contour of the string curvature produced by its system of "shoulder like ways" to follow neck curvature. This interruption is perceived in two locations, the surface between the first string and the outside edges at the posts and the surface between the sixth string and the outside edges at the posts on a six-string guitar. The outside top surfaces of the bridge bar also create right angles with the bridge bar's side surfaces. Discomfort and or annoyance can often be experienced as varying degrees of hand pressure applied to the strings during palm muting perceive the angles and interruption in contour. Any kind of discomfort or annoyance can contribute to body tension.

The SaddleRail Bridge invention increases the comfort level associated with palm muting by eliminating angular surfaces and interruptions in the bridge bar's contour as a result of its curved design. The bridge bar curvature preferably follows the neck curvature and continues its entire length creating an ergonomic, uninterrupted contour for the hand while palm muting. The outside edges of the bridge bar contact areas are curved 34 (FIG. 9) and the saddle shoulders have, e.g., a 0.030-inch radial arc eliminating the uncomfortable perception of angles. The saddle shoulders do not function as a string vibration transmitter or support the strings, as do the saddle shoulders in a Tune-o-Matic™ style bridge. Their function is to create a more continuous uninterrupted surface contour providing a more comfortable feel when applying varying degrees of pressure during palm muting and overall contact with the bridge. Since they do not contact the bridge bar and have a negligible influence on tone, their elimination is also an option.

Saddle Replacement

In a typical procedure for replacing a typical Tune-o-Matic™ style saddle one would have to remove the string, remove the retaining wire, remove the very small retaining clip with a tool, unscrew the adjustment screw out of the saddle base (tongue) until the saddle is free, remove the saddle, insert a new saddle, feed the screw into the front bridge bar wall hole, thread the screw into the threaded saddle until it is threaded far enough from the saddle for the screw to rest in its hole at the rear bridge bar, feed the screw tip into the hole at the rear bridge wall, push the screw head tight to the front bridge bar while reinserting the retaining clip with a fine tool, replace the retaining wire and re-intonate. This requires on the order of thirteen steps including the removal and reinstallation of a retaining clip too small to be installed with human fingers, thus requiring a tool such as a very small needle noise pliers and very good eyesight or magnification equipment. Manipulating pliers to insert a retaining clip this small is a series of procedures in itself and requires a skill set. The screw and saddle are also very small and difficult to handle with adult size fingers.

Saddlerail Replacement

Ease of Interchange and its Relevance to Audio Recording

Being a preferably one-piece dual element, a rail plus a saddle, a SaddleRail Bridge's saddlerail is easily interchanged simply by removing the string from the saddle, loosening the set screw, e.g., using an Allen wrench, sliding the saddle rail out of its dovetail slot, replacing it by sliding a new one in the slot, reinstalling the string and locking the set screw after intonation. The procedure consists of seven steps and takes considerably less time to execute than for the Tune-o-Matic™ style saddle. There are no small parts that require disassembly or handling, and replacement requires no real tool related skill set. The SaddleRail Bridge enables the user to interchange its separate components for their combined influence on tone and feel allowing the user to obtain different tone and feel scenarios for the same instrument both quickly and easily. The ease of interchange also makes it practical to do at recording sessions and instances where time is a concern.

Intonation

The SaddleRail Bridge improves the method of attaining adjustable intonation in the Tune-o-Matic™ style bridge by replacing the unnecessary, problematic saddle adjustment screws with its saddlerail system. The ability to adjust standard string intonation without releasing string tension by turning a screw with a screwdriver is unnecessary and has outlived its usefulness. With the advent of digital tuners, accurate pitch can be attained quickly and easily by anyone without possessing expensive equipment or knowledge making the intonation process precise and dramatically easier. The intonation process simply requires a series of retuning after nodal point adjustments.

The invention's saddlerails are easily adjusted for intonation by loosening the setscrew, releasing string pressure (e.g., by a quarter tone, if necessary), and gently tapping the exposed rails forward or backward with any number of nonspecific tools such as a dowel. Its adjustments are firm and precise and the user will not experience the play that is often present with a saddle adjustment screw.

The SaddleRail Bridge eliminates the outdated, unnecessary saddle adjustment screw and alike, thereby eliminates the list of associated problems described in detail in this text.

Manufacture

The invention is easily milled, e.g., on CNC machines, resulting in close tolerances. It eliminates the complicated design of a typical Tune-o-Matic™ style bridge, which equates to shorter milling time and lower manufacturing costs. The invention's assembly requires close to half the number of steps and far less time to assemble than that of a Tune-o-Matic™ style bridge. As previously stated, the huge majority of Tune-o-Matic™ style bridges are cast in metal alloy.

REFERENCES

U.S. Pat. No. 2,740,313

U.S. Pat. No. 6,613,968

"How to Make Your Electric Guitar Play Great", Erlewine, D.; Library of Congress Control No. 00-136124, ISBN 0-87930-607-7, p. 63-95

While the invention has been described with reference to specific embodiments, those skilled in the art will understand that various changes may be made and equivalents may be substituted for elements thereof without departing from the true spirit and scope of the invention. Example: A cylindrical rail or T-slotted rail and accompanying dovetail slot can easily replace a dovetail mortise and tenon and still maintain its compression capabilities. In addition, modifications may be made without departing from the essential teachings of the invention such as its tone design interchangeability.

What is claimed is:

1. An instrumental bridge for a fretted stringed musical instrument comprising:

a lateral support housing having a top surface, a bottom surface, a front longitudinal surface and a rear longitudinal surface; and a plurality of saddlerails, the plurality of saddlerails comprising a rail portion and a curved saddle, wherein the lateral support housing includes a plurality of apertures extending transversely from the front longitudinal surface to the rear longitudinal surface, the plurality of apertures configured to receive said plurality of saddlerails, wherein said plurality of saddlerails are configured to slide transversely within said plurality of apertures.

2. The bridge of claim 1, wherein the plurality of apertures are dovetail slots.

3. The bridge of claim 2, wherein said rail portion of said saddlerail is supported and encased on three sides in said plurality of said dovetail slots of said lateral support housing and wherein said curved saddle supports a string, wherein said string tension exerted on said curved saddle compresses said rail in said dovetail slot.

4. The bridge of claim 1, wherein said curved saddle has significant lateral surface area from a nodal point to said saddle's rear termination.

5. The bridge of claim 4, wherein said curved saddle does not create an angular string bend.

6. The bridge of claim 1, wherein said lateral support housing and said saddlerails are comprised of wood, metal, or manmade materials.

7. The bridge of claim 6, wherein:

a) at least two of said saddlerails are comprised of different material relative to each other;

b) said lateral support housing and at least one saddlerail are comprised of different material relative to each other;

c) all of said saddlerails are comprised of the same material; or d) all of said saddlerails and said lateral support housing are comprised of the same material.

8. The bridge of claim 6, wherein said materials are selected from the group consisting of wood, bone, metal, plastic and composites.

9. The bridge of claim 6, wherein said wood is selected from the group consisting of any species of domestic and exotic hardwood.

10. The bridge of claim 6, wherein said wood is selected from the group consisting of ebony, maple, rosewood, Pau Ferro, and heat-treated hardwood.

11. The bridge of claim 6, wherein said metal is selected from the group consisting of nickel, silver, stainless steel, aluminum, brass, bronze, copper, Inconel, magnesium, Monet, steel, titanium, Zircaloy, and Zirconium or any metal.

12. The bridge of claim 2, wherein said saddle comprises a nodal point edge.

13. The bridge of claim 12, wherein said nodal point edge is transverse to a string.

14. The bridge of claim 12, wherein said nodal point edge is the width of the saddle.

15. The bridge of claim 12, wherein the face of said saddle, which faces the nut, is perpendicular to said rail.

16. The bridge of claim 12, wherein said nodal point edge is at a distance far enough from said rail to allow unobstructed string waver.

17. The bridge of claim 1, wherein said rail comprises a vertical hole through said rail.

18. The bridge of claim 17, wherein said hole is threaded.

19. The bridge of claim 17, further comprising a setscrew wherein said setscrew fits through said hole.

20. The bridge of claim 17, comprising a threaded insert wherein said insert fits through said hole.

21. The bridge of claim 20, further comprising a setscrew, wherein said setscrew threads into said threaded insert.

22. The bridge of claim 1, wherein said saddle comprises curved shoulders.

23. The bridge of claim 1, wherein said lateral support housing comprises a curved top edge.

24. The bridge of claim 1, wherein said lateral support housing comprises a chamfered bottom edge.

25. The bridge of claim 1, wherein said dovetail slot is deep enough and said saddle is high enough to allow said string to descend to a tailpiece without making contact with the rear surface of said lateral support housing.

26. A stringed instrument comprising the bridge of claim 1.

27. The bridge in claim 1, wherein said curved saddles are manufactured in incremental size variations to effectively raise and lower said nodal edge to thereby evenly match the distance between said string and instrument fretboards at flat or radius profiles.

28. The bridge of claim 1, wherein each of the plurality of saddlerails are interchangeable to influence on aesthetics, harmonics, and string vibration feel.

29. The bridge of claim 1, wherein said dovetail slots allow space for instrument strings to descend from the saddle to the tailpiece or body of the instrument without making contact with said bridge components.

30. The bridge of claim 1, wherein shoulder surfaces of the said curved saddles have a radius shape.

31. The bridge of claim 1, whereby the lateral support housing or the plurality of saddlerails are carved, etched, or manufactured in any way, embodying representation of flora, insect, mammalian, fish, fictional character, mythological creature, inanimate object, symbol, geometrical form, art abstraction, or personification thereof for ornamentation.

32. The bridge in claim 1, whereby the length and mass of the lateral support housing or plurality of saddlerails are altered to influence tone, aesthetics, comfort.

33. The bridge in claim 1, whereby the length and mass of the lateral support housing or plurality of saddlerails are altered or modified to house any electronic control such as volume and tone controls.

34. The bridge in claim 1, wherein the lateral support housing includes mounting holes on opposite ends thereof, the mounting holes extending through the top surface and the bottom surface of the lateral support housing.

35. The bridge in claim 1, wherein the lateral support housing is curved along the bottom surface to correspond with the curvature of the fretted musical instrument.

* * * * *